US005356723A

United States Patent [19]

Kimoto et al.

[11] Patent Number: 5,356,723

[45] Date of Patent: Oct. 18, 1994

[54] MULTILAYER PLATED ALUMINUM SHEETS

[75] Inventors: Masanari Kimoto, Kobe; Tetsuaki Tsuda, Nishinomiya; Masanori Tsuji, Hannan; Yoshihiko Hoboh, Osaka; Hiroshi Ikeda, Nagoya; Takao Aimu, Nagoya; Hideyuki Uto, Nagoya; Kiyoyuki Fukui, Kobe; Keizo Namba, Nagoya, all of Japan

[73] Assignees: Sumitomo Metal Industries, Ltd., Osaka; Sumitomo Light Metal Industries, Ltd., Tokyo, both of Japan

[21] Appl. No.: 992,111

[22] Filed: Dec. 17, 1992

[30] Foreign Application Priority Data

Dec. 18, 1991 [JP] Japan ..... 3-335229
Jul. 2, 1992 [JP] Japan ..... 4-175755
Jul. 3, 1992 [JP] Japan ..... 4-177103

[51] Int. Cl.[5] ..... B32B 15/20

[52] U.S. Cl. ..... 428/650; 428/658; 428/935

[58] Field of Search ..... 205/139, 153, 213; 428/650, 658, 935

[56] References Cited

U.S. PATENT DOCUMENTS

| | | | |
|---|---|---|---|
| 1,627,900 | 5/1927 | Hewitson | 205/213 |
| 2,676,916 | 4/1954 | Zelley | 205/213 |
| 3,284,323 | 11/1966 | Leloup | 205/213 |
| 3,909,209 | 9/1975 | Kruper et al. | 428/650 |
| 3,969,199 | 7/1976 | Berdan et al. | 205/213 |
| 4,273,837 | 6/1981 | Coll-Palagos | 428/658 |
| 4,920,639 | 7/1990 | Ohshima et al. | 428/658 |

FOREIGN PATENT DOCUMENTS

| | | | |
|---|---|---|---|
| 1496225 | 8/1967 | France . | |
| 2266753 | 10/1975 | France . | |
| 58-81961 | 5/1983 | Japan | 428/650 |
| 61-157693 | 7/1986 | Japan . | |
| 2-19488 | 1/1990 | Japan . | |
| 2-19489 | 1/1990 | Japan . | |
| 2-19490 | 1/1990 | Japan . | |
| 3-146693 | 6/1991 | Japan . | |
| 1133679 | 11/1968 | United Kingdom . | |
| 2179058A | 2/1987 | United Kingdom | 428/650 |

OTHER PUBLICATIONS

Walter Meyer, "Electroplating on Aluminum", The Monthly Review, Mar. 1946, pp. 269–270, 273–274, 277.

T. E. Such et al, "An Improvement in the Zincate Method for Plating on Aluminum", Plating, vol. 52, No. 10, Oct. 1965, pp. 1027–1034.

George A. DiBari, "Plating on Aluminum: Pretreatments and Corrosion Performance", Plating and Surface Finishing, vol. 64, No. 5, May 1977, pp. 68–74.

Cveta Milovanovic et al, "Direct Nickel Plating on Aluminum and its Alloys", Chemical Abstracts, vol. 72, No. 10, Mar. 9, 1970, p. 530.

*Primary Examiner*—John Zimmerman

*Attorney, Agent, or Firm*—Burns, Doane, Swecker & Mathis

[57] ABSTRACT

A multilayer plated aluminum sheet suitable for use in automobile body panels comprises a base aluminum sheet made of aluminum or an aluminum alloy and has a first layer of zinc or a zinc alloy formed by displacement plating on the surface of the aluminum sheet and one or more layers of electroplated coating formed on the first layer by electroplating in an acidic bath. Preferably, the upper electroplated coating comprises at least one layer of zinc or a zinc alloy and the uppermost layer of the coating is formed from a metallic material having a melting point above 500° C.

34 Claims, No Drawings

MULTILAYER PLATED ALUMINUM SHEETS

BACKGROUND OF THE INVENTION

This invention relates to multilayer plated aluminum sheets suitable for use as automobile body panels. More particularly, it is concerned with aluminum sheets which have two or more plated coating layers, which can be subjected to zinc phosphating without substantial dissolution of Al ions, and which exhibit good corrosion resistance before and after finish paint coating as well as good plating adhesion and good press formability, all of these properties being required for automobile body panels.

In recent years, the requirements for steel sheets used as automobile body panels have become increasingly severe with respect to protection from corrosion caused by antifreezing agents spread on roads in cold regions and with respect to weight reduction for decreasing fuel consumption. In order to protect automobile bodies from corrosion, surface-treated steel sheets such as zinc- or zinc alloy-plated steel sheets have been applied to such panels. As a measure for weight reduction, use of high tensile strength steel sheets has increased since the sheet thickness can be reduced with such steel sheets.

In order to further reduce the weight of automobile bodies, in more recent years, aluminum sheets made of aluminum or an aluminum alloy have been used in some automobile bodies. In such cases, aluminum sheets usually constitute only part of the body panels required to assemble an automobile body, the remaining portion of the body panels being comprised of steel sheets. Thus, in most cases, aluminum sheets are used together with steel sheets to assemble automobile bodies.

A typical assembly line for automobile bodies made of steel sheets includes the steps of press-forming steel sheet panels into desired shapes, assembling the formed steel sheets by means of resistance spot welding to form an automobile body, and finally subjecting the assembled body to zinc phosphating, electro-deposition coating, and spray coating in that order. When aluminum sheets are partly applied to automobile bodies, it is desired that it be possible to process aluminum sheets along with steel sheets in the same assembly line of the above-mentioned sequence. This eliminates the necessity to install a separate assembly line for aluminum sheets and maintains the continuity of the assembly process.

However, in such cases, a problem occurs in the zinc phosphating stage. Zinc phosphate treatment is applied prior to painting in order to improve the adhesion of paint coating and hence the corrosion resistance of automobile bodies.

Zinc phosphating of aluminum sheets, however, not only does not form a good zinc phosphate coating on the surface of each aluminum sheet, but also causes dissolution of the aluminum sheet at the surface thereof, thereby contaminating the zinc phosphating solution with Al ions dissolved out of the sheet. As a result, as the concentration of Al ions in the zinc phosphating solution is increased to as low as several parts per million, steel sheets treated in the solution are adversely affected such that a good zinc phosphate coating can no longer be formed on the steel surfaces.

In order to solve this problem, it is proposed in Japanese Unexamined Patent Publication No. 61-157693(1986) that the coatability of an aluminum sheet with zinc phosphate can be improved by forming a plated coating of zinc, a zinc alloy, or an iron alloy at a weight of at least 1 $g/m^2$ on the surface of the sheet. According to that publication, since the plated coating protects the aluminum sheets sufficiently to prevent dissolution of Al ions in a zinc phosphating solution during subsequent zinc phosphating stage, a satisfactory zinc phosphate coating can be formed on both of aluminum and steel surfaces when aluminum sheets and steel sheets are treated in the same solution.

However, the plated coating is formed by electroplating in an acidic sulfate bath prior to press forming according to the method described in that publication. It is well known that the surface of an aluminum sheet is covered with a thin oxide film, which greatly interferes with deposition of electroplated coating. Therefore, the resulting plated coating has poor adhesion and it may readily peel off from the aluminum sheet during press forming, thereby making it difficult to achieve the above-described desired effects of the plated coating.

In order to overcome this problem, it is proposed in Japanese Unexamined Patent Publication No. 3-146693(1991) that the surface of an aluminum sheet be coated with a first layer of a nickel-plated coating, which is formed either by displacement plating in an acidic chloride bath containing hydrogen fluoride or by electroplating in an acidic sulfate bath. A zinc- or zinc alloy-plated coating is formed on the first nickel layer, and it has good adhesion to the underlying first layer.

However, since Ni is nobler than Al, Al has a higher ionization tendency, and the first nickel layer may cause galvanic corrosion of the base aluminum sheet, which, in turn, may cause blistering of the overlaid zinc- or zinc alloy-plated layer and finish paint coating, thereby significantly degrading corrosion resistance in those areas where the finish paint coating is injured. Furthermore, the nickel layer is stiff and susceptible to flaking. When the resulting flake penetrates into the aluminum sheet, a notch is formed and it may cause the aluminum sheet to be broken during press forming by stress concentration at the notch.

Aluminum sheets have high surface activity and form on the surface thereof a firm oxide film which is readily regenerated after removal. Such an oxide film significantly interferes with the adhesion of a plated coating formed thereon. Therefore, when an aluminum sheet is electroplated, the sheet is usually pretreated so as to remove the oxide film immediately before electroplating.

For this purpose, displacement plating (also called immersion plating) with zinc or a zinc alloy is employed. The displacement plating with zinc or a zinc alloy is merely intended to remove the oxide film and enhance the adhesion of an electroplated coating formed thereon.

Japanese Unexamined Patent Publications Nos. 2-19488(1990), 2-19489(1990), and 2-19490(1990) disclose pretreatment of an aluminum sheet with a zincate bath to form a first zinc coating by displacement plating before the sheet is electroplated with a zinc alloy in a basic bath. However, the use of a basic bath in the electroplating stage may result in pitting corrosion and alkaline dissolution of the aluminum sheet caused by hydroxyl ions present in the bath, thereby re-exposing the surface of the aluminum sheet and degrading the adhesion of the zinc alloy plated coating formed thereon.

It is also well known that spot welding of aluminum sheets is more difficult than spot welding of steel sheets since aluminum is higher than steel in both electric and thermal conductivity. The spot weldability of aluminum sheets is particularly poor with respect to the number of maximum weldable spots in continuous spot welding before the electrodes of a spot welder are damaged (hereafter referred to merely as "number of weldable spots"). For example, more than 3,000 spots can be continuously welded with steel sheets before the electrodes of the spot welder are damaged. In contrast, in spot welding of aluminum sheets, the number of weldable spots is on the order of 300 to 500, and the spot welding line must be stopped after welding of 300 to 500 spots to exchange or grind the damaged electrodes, thereby significantly decreasing the efficiency.

Electroplating of aluminum sheets with zinc or a zinc alloy, for example, by the method disclosed in Japanese Unexamined Patent Publication No. 3-146693(1991) also serves to improve the spot weldability of the sheets. However, there is a need of further improvement in spot weldability of aluminum sheets.

SUMMARY OF THE INVENTION

It is an object of the present invention to provide aluminum sheets suitable for use as automobile body panels.

Another object of the present invention is to provide aluminum sheets which can be treated by zinc phosphating together with steel sheets without substantial damage to the treating solution and the aluminum and steel sheets to be treated.

A further object of the present invention is to provide aluminum sheets having good corrosion resistance after finish paint coating and improved press formability and spot weldability.

A still further object of the present invention is to provide multilayer plated aluminum sheets having good adhesion of the multilayer plated coating.

The present invention provides multilayer plated aluminum sheets suitable for use in automobile body panels, which is comprised of an aluminum sheet made of aluminum or an aluminum alloy, the aluminum sheet having a first layer of zinc or a zinc alloy formed by displacement plating on the surface of the aluminum sheet, and one or more layers of electroplated coating formed on the first layer by electroplating in an acidic bath.

Additional objects and advantages of the present invention will be understood from the following detailed description of the invention.

DESCRIPTION OF THE INVENTION

The base aluminum sheet may be either made of aluminum such as JIS 1000 series aluminum materials or an aluminum alloy such as JIS 5000 or 6000 series aluminum materials. Typical aluminum alloys useful for automobile bodies include A1-5% Mg alloys and A1-0.5% Mg-1% Si alloys.

The surface of the aluminum sheet is coated with a first layer of zinc or a zinc alloy by means of displacement plating. The displacement plating can be conducted in a basic plating bath after the surface of the aluminum sheet is degreased in a conventional manner. Due to the amphoteric nature of aluminum, any oxide film on the surface of the aluminum sheet is dissolved out under basic conditions. Therefore, when an aluminum sheet is subjected to displacement plating in a basic bath, a fresh surface of the sheet is exposed to undergo a displacement reaction with zinc or a zinc alloy in the bath and the resulting zinc- or zinc alloy-plated layer has strong metal-metal adhesion to the base aluminum sheet.

The basic bath used in displacement plating may be a cyanide bath, but preferably it is an alkali bath which contains sodium hydroxide, zinc oxide, and optionally one or more alloying elements in the form of hydroxides, oxides, or appropriate salts such as chlorides. The alkali bath usually contains 100–600 g/l of sodium hydroxide and 10–200 g/l of zinc oxide and has a pH in the range of 9–14. The basic plating bath may further contain other salts such as Rochelle salt as electrolytes.

Preferably the first zinc or a zinc alloy layer formed by displacement plating has a coating weight of 0.1–5 $g/m^2$ and more preferably 0.2–1.0 $g/m^2$. With a coating weight of less than 0.1 $g/m^2$, the first layer may not cover the surface of the aluminum sheet completely, thereby adversely affecting corrosion resistance, weldability, and press formability. A coating weight of greater than 5 $g/m^2$ requires an excessively prolonged treatment time in displacement plating. The plating conditions may generally be the same as those employed in the conventional zincate treatment, for example, at a temperature around 20° C. with a treatment time of 20–60 seconds, and should be selected so as to form a plated coating having the desired weight.

The first layer is preferably formed from a zinc alloy with one or more alloying elements which are nobler than Zn. For example, the zinc alloy may be an alloy of zinc with at least one alloying element selected from Ni, Fe, Co, and Cr. The total content of alloying elements in the zinc alloy is not critical, but it is preferably at most 30% and more preferably 1–20% by weight. In general, a first layer formed from such a zinc alloy has increased adhesion to the base aluminum sheet compared to a first layer of pure zinc. The reason for this phenomenon is not clear but at present it is thought to be as follows.

In displacement plating of a zinc alloy with one or more nobler alloying elements, the alloying element or elements are initially deposited by displacement reaction on the aluminum surface to form discrete, particulate deposits. In the subsequent stage, zinc is deposited so as to entangle with the initial deposits, leading to an increase in the adhesion of the resulting displacement-plated coating. Therefore, the resulting zinc alloy coating formed by displacement plating may not necessarily form an alloy in the strict sense, but may still remain at least partly in the state of a physical mixture. The presence of zinc as a physical mixture with alloying elements in the first layer may facilitate the sacrificial rust-preventing ability of the layer.

If desired, in the same manner as in the conventional zincate treatment, the displacement plating may be repeated once or more after the previously-plated coating has been dissolved out with a nitric acid or sulfuric acid solution, resulting in the formation of a denser, strongly adhered plated coating.

The first layer formed on the surface of the aluminum sheet is overlaid with one or more layers of electroplated coating to form a multilayer plated aluminum sheet of the present invention. The upper electroplated coating protects the underlying first, thin zinc or zinc alloy layer and the base aluminum sheet, resulting in improvement in corrosion resistance before and after finish paint coating, and it also contributes to improvement in coatability with zinc phosphate and weldability of the base material. Due to the presence of the first layer between the upper electroplated coating and the base aluminum sheet, the upper electroplated coating has improved adhesion and therefore can be prevented from peeling off during press forming and can effectively protect the base aluminum sheet against corrosion before and after finish paint coating and dissolution during zinc phosphating. As a result, the multilayer plated aluminum sheet can be processed along with steel sheets in the same assembly line without causing significant problems. Moreover, even if an overlaid finish paint coating is injured, the multilayer plated aluminum sheet exhibits improved corrosion resistance in the injured portions.

Preferably each electroplated layer has a coating weight of 0.1–40 g/m$^2$. The coating weight is more preferably at least 0.5 g/m$^2$ and most preferably at least 1 g/m$^2$.

It is preferable that the upper electroplated coating comprise at least one layer of zinc or a zinc alloy. For the electroplated coating, the zinc alloy is preferably an alloy of zinc with one or more alloying elements selected from Ni, Fe, Co, Cr, and Mn. The total content of alloying elements in the zinc alloy for the upper electroplated coating is not critical and may be varied widely.

It is also preferable that the uppermost layer of the upper electroplated coating be formed from a metallic material having a melting point above 500° C. Examples of such metallic materials useful in the uppermost electroplated layer include zinc alloys such as those mentioned above, as well as Fe, Ni, Cr, Co and Ti metals and alloys of these metals. The application of such a high-melting metallic material to the outermost surface of the electroplated coating effectively prevents the metal or alloy present in the electroplated coating from diffusing into the electrodes of a spot welder during spot welding to form a brittle alloy. As a result, the rate of consumption of the electrodes is diminished and the spot weldability (number of weldable spots) is significantly improved. For this purpose, the uppermost layer has a coating weight of at least 1 g/m$^2$ and more preferably at least 5 g/m$^2$.

Therefore, many variations are possible for the preferable construction of the upper electroplated coating. For example, when the uppermost layer of the coating is formed from a zinc alloy melting above 500° C., the uppermost layer may be formed directly on the first layer, although one or more intermediate electroplated layers may be interposed between the uppermost layer and the first layer. When the uppermost layer is formed from a zinc-free or zinc-lean metallic material melting above 500° C., it is preferable that one or more intermediate electroplated layers be interposed between the uppermost layer and the first layer. In this case, at least one of the intermediate electroplated layers is preferably formed from zinc or a zinc alloy.

Since the aluminum sheet is coated with the first zinc or zinc alloy layer, which is less reactive with oxygen than aluminum and less susceptible to the formation of surface oxide film, good adhesion of the upper electroplated coating can be obtained by electroplating in an acidic electroplating bath. Preferably an acidic sulfate bath is used to form the upper electroplated coating, particularly during the formation of at least the lowermost layer thereof which is in direct contact with the first layer if the upper coating has two or more electroplated layers. Although an acidic chloride bath may be used, it may sometimes cause pitting corrosion of the base aluminum sheet by attack with chloride ions. The use of a basic electroplating bath is not preferred in the formation of the upper electroplated coating.

The electroplating can be conducted in a conventional manner under conditions which should be selected so as to form an electroplated coating with the desired weight. The electroplating conditions may vary depending on the metal species to be deposited by electroplating.

The following examples are presented to further illustrate the present invention. These examples are to be considered in all respects as illustrative and not restrictive.

EXAMPLE 1

Aluminum sheets for use in automobile hood panels having a thickness of 1.0 mm and made of A1-4.5% Mg alloy were treated in the following sequence to form a first, displacement-plated layer and an upper electroplated coating of one or two layers:

Solvent Degreasing→Alkali Degreasing→Water Rinsing→Pickling→Water Rinsing→Displacement Plating→Water Rinsing→[Electroplating→Water Rinsing]→Drying.

When the upper electroplated coating consisted of two layers, the steps in brackets were repeated. In this case, the lower (initial) electroplated layer was referred to as a middle layer and the upper (later) electroplated layer was referred to as the uppermost layer. When the upper electroplated coating was a single layer, it constituted the uppermost layer. The displacement plating step and the electroplating step were conducted under the following conditions.

[Displacement Plating]

Plating bath: Commercially available plating bath for displacement plating which contained 120 g/l of NaOH and 20 g/l of ZnO. Optionally Ni, Cr, or Co was added in the form of its chloride in an amount sufficient to form a zinc alloy coating of the desired composition.

Bath pH: 10–12

Bath temperature: 20° C.

Duration: 5–300 seconds by immersion in the bath.

[Electroplating]

Plating bath: Sulfate bath containing 100–400 g/l of $ZnSO_4$. To the $ZnSO_4$ bath, a sulfate of Ni, Fe, Co, or Mn was added in an amount sufficient to form a zinc alloy coating of the desired composition.

Bath pH: 1.5–2.0

Bath temperature: 60° C.

Current density: 20–100 A/dm$^2$

The coating weights of the first layer and each layer of the upper electroplated coating were adjusted by the duration of immersion in the plating bath and duration of current passage, respectively.

The resulting multilayer plated aluminum sheets were evaluated with respect to adhesion of the plated coating, dissolution of aluminum ions during zinc phosphating (zinc phosphating property), and corrosion resistance after finish paint coating in the following manner.

[Adhesion of Plated Coating]

A test specimen having no finish paint coating was press-formed by punch stretching to a depth of 5 mm according to the Erichsen A method. The stretched area was subjected to an adhesive tape peeling test and the adhesion of the plated coating was evaluated by the amount of flakes of the plated coating attached to the adhesive tape as follows:

O: Little flakes were observed on the adhesive tape (acceptable)

Δ: Flakes occupied 10–50% of the entire area of the tape (unacceptable)

X: Flakes occupied more than 50% of the entire area of the tape (unacceptable)

[Zinc Phosphating Property]

Test specimens each measuring 150 mm long and 70 mm wide were subjected one by one to zinc phosphating by immersion in a commercially available zinc phosphating solution at 43° C. for 3 minutes at a rate of 0.5 $m^2$ per liter of the solution. The Al ion concentration of the zinc phosphating solution after the treatment was determined and the degree of dissolution of Al ions during zinc phosphating was evaluated as follows:

Al ion concentration

O: Less than 1 ppm (acceptable)

Δ: 1 to 10 ppm (unacceptable)

X: Greater than 10 ppm (unacceptable)

[Corrosion Resistance After Finish Paint Coating]

A test specimen was coated in a standard manner with a finish paint coating for automobile bodies which consisted of a 20 μm-thick cationically-electrodeposited layer, a 40 μm-thick intermediate coat layer of an alkyd resin, and a 40 μm-thick topcoat layer of a melamine-polyester resin.

After the finish-coated test specimen was injured by scribing a cross to a depth sufficient to reach the base aluminum sheet, it was subjected to an accelerated cyclic corrosion test in which the test specimen was repeatedly exposed to a 24-hour cycle consisting of salt spraying (5% NaCl, 35° C.) for 7 hours, drying (50° C.) for 2 hours, and wetting (85% RH, 50° C.) for 15 hours. After exposure for 30 cycles, the maximum width of blisters formed on either side of the cross-scribed injury was measured to evaluate the corrosion resistance after finish paint coating as follows:

Rating 1: Maximum blister width<0.5 mm (acceptable)

Rating 2: Maximum blister width<1.0 mm (acceptable)

Rating 3: Maximum blister width<2.0 mm (unacceptable)

Rating 4: Maximum blister width<3.0 mm (unacceptable)

Rating 5: Maximum blister width>3.0 mm (unacceptable)

The results of these tests and the coating weight and composition of each plated layer of the multilayer plated aluminum sheets are shown in Table 1. In Table 1 and subsequent tables, the asterisked run numbers are comparative examples.

All the multilayer plated aluminum sheets according to the present invention had good adhesion of the plated coating and they were improved in zinc phosphating property and corrosion resistance after finish paint coating.

EXAMPLE 2

Multilayer plated aluminum sheets were prepared in the same manner as described in Example 1 except that the first layer was formed under the following conditions.

[Conditions for Displacement Plating]

Plating bath: Aqueous solution containing 300–600 g/l of NaOH and 10–200 g/l of ZnO, to which an oxide or hydroxide of Ni, Fe, Cr, or Co was added in an amount of 0–100 gl. The solution was diluted before use.

Bath pH: 10–12

Bath temperature: 10°–50° C.

Duration: 5–300 seconds

Following the procedures described in Example 1, the resulting multilayer plated aluminum sheets were evaluated with respect to adhesion of the plated coating and zinc phosphating property. The corrosion resistance after finish paint coating and press formability were also evaluated in the following manner.

[Corrosion Resistance After Finish Paint Coating]

A finish paint coating was applied to a test specimen in the same manner as described in Example 1 except that the topcoat layer of the finish paint coating was the same as the intermediate coat layer, i.e., 40 μm-thick alkyd resin coating. The testing method of the paint-coated test specimen was also the same as in Example 1 except that the 24-hour cycle employed in the accelerated cyclic corrosion test, to which the cross-scribed, paint-coated test specimen was exposed, consisted of wetting (85% RH, 60° C.) for 4 hours, low-temperature drying (50° C.) for 4 hours, salt spraying (5% NaCl, 60° C.) for 4 hours, high-temperature drying (60° C.) for 8 hours, and freezing (−20° C.) for 4 hours. The corrosion resistance after finish paint coating was evaluated in terms of the maximum width of blisters as follows:

O: Maximum blister width<1 mm (acceptable)

Δ: Maximum blister width≧1 mm and <5 mm (unacceptable)

X: Maximum blister width≧5 mm (unacceptable)

[Press Formability]

The testing procedure and evaluation manner for press formability were the same as those used in Example 1 to test for adhesion of plated coating.

The results of these tests and the coating weight and composition of each plated layer of the multilayer plated aluminum sheets are shown in Table 2. All the multilayer plated aluminum sheets according to the present invention had good adhesion of the plated coating and they are improved in zinc phosphating property and corrosion resistance after finish paint coating. Furthermore, they exhibited improved press formability.

EXAMPLE 3

Multilayer plated aluminum sheets were prepared in the same manner as described in Example 2 except that the upper electroplated coating was formed under the following conditions.

[Conditions for Electroplating]

Plating bath: Sulfate bath having a composition adjusted so as to form a zinc or zinc alloy coating of the desired composition.

Bath pH: 1.5–2.5

Bath temperature: 50°–60° C.

Current density: 20–100 $A/dm^2$

The adhesion of plated coating for each of the resulting multilayer plated aluminum sheets was evaluated following the procedure described in Example 1. The corrosion resistance after finish paint coating was tested following the procedure described in Example 2, but the results were evaluated in the same manner as in Example 1, i.e., as follows:

Rating 1: Maximum blister width<0.5 mm (acceptable)

Rating 2: Maximum blister width<1.0 mm (acceptable)

Rating 3: Maximum blister width<2.0 mm (unacceptable)

Rating 4: Maximum blister width<3.0 mm (unacceptable)

Rating 5: Maximum blister width≧3.0 mm (unacceptable)

The spot weldability of the multilayer plated aluminum sheets was evaluated in the following manner.

[Spot Weldability]

Test specimens were resistance-welded by continuous spot welding using a single spot welder under the following conditions.

Current: 27,000 A

Welding force: 300 kgf

Weld time: 6 cycles (at 60 Hz)

Electrodes: Dome-shaped electrodes (Cu-1%Cr alloy)

Procedure: A spot welding cycle in which 20 spots were continuously welded at an interval of 2 seconds for each spot was repeated with a rest time of 40 seconds or longer after each cycle. Whenever 100 spots had been welded, three spots were sampled at random as shearing test specimens and subjected to a tensile test to determine the shear load required to detach the weld.

The spot weldability was evaluated in terms of the number of spots welded before the shear load (average value for the three spots) decreased to less than 200 kgf. The spot weldability is regarded as acceptable when this number of spots is 1500 or more.

The results of these tests and the coating weight and composition of each plated layer of the multilayer plated aluminum sheets are shown in Table 3. All the multilayer plated aluminum sheets according to the present invention had good adhesion of the plated coating and improved corrosion resistance after finish paint coating. Furthermore, they exhibited improved spot weldability.

It will be appreciated by those skilled in the art that numerous variations and modifications may be made to the invention as described above with respect to specific embodiments without departing from the spirit or scope of the invention as broadly described.

TABLE 1

| Run No. | First Layer (Displacement Plated Coating) Type | First Layer Weight ($g/m^2$) | Electroplated Coating: Middle Layer Type | Middle Layer Weight ($g/m^2$) | Uppermost Layer Type | Uppermost Layer Weight ($g/m^2$) | Adhesion of Plated Coating | Zinc Phosphating Property | Corrosion Resistance After Paint Coating |
|---|---|---|---|---|---|---|---|---|---|
| 1* | Zn-15% Ni | 0.05 | — | — | — | — | Δ | X | 2 |
| 2* | " | 0.1 | — | — | — | — | ○ | Δ | 3 |
| 3* | " | 1 | — | — | — | — | ○ | Δ | 3 |
| 4* | " | 5 | — | — | — | — | ○ | ○ | 4 |
| 5 | " | 0.1 | — | — | Zn-15% Ni | 0.1 | ○ | ○ | 2 |
| 6 | " | 0.1 | — | — | " | 0.5 | ○ | ○ | 2 |
| 7 | " | 0.1 | — | — | " | 1 | ○ | ○ | 1 |
| 8 | " | 0.1 | — | — | " | 10 | ○ | ○ | 1 |
| 9 | " | 0.1 | — | — | " | 20 | ○ | ○ | 1 |
| 10 | " | 0.1 | — | — | " | 40 | ○ | ○ | 1 |
| 11 | " | 1 | — | — | " | 0.5 | ○ | ○ | 2 |
| 12 | " | 1 | — | — | " | 1 | ○ | ○ | 1 |
| 13 | " | 1 | — | — | " | 10 | ○ | ○ | 1 |
| 14 | " | 1 | — | — | " | 20 | ○ | ○ | 1 |
| 15 | " | 1 | — | — | " | 40 | ○ | ○ | 1 |
| 16 | " | 5 | — | — | " | 0.5 | ○ | ○ | 1 |
| 17 | " | 5 | — | — | " | 1 | ○ | ○ | 1 |
| 18 | " | 5 | — | — | " | 10 | ○ | ○ | 1 |
| 19 | " | 5 | — | — | " | 20 | ○ | ○ | 1 |
| 20 | " | 5 | — | — | " | 40 | ○ | ○ | 1 |
| 21 | " | 1 | Zn-15% Ni | 10 | Zn-15% Ni | 10 | ○ | ○ | 1 |
| 22 | " | 1 | " | 10 | Zn | 10 | ○ | ○ | 1 |
| 23 | " | 1 | " | 10 | Zn-15% Co | 10 | ○ | ○ | 1 |
| 24 | " | 1 | " | 10 | Zn-15% Mn | 10 | ○ | ○ | 1 |
| 25 | " | 1 | " | 10 | Zn-15% Cr | 10 | ○ | ○ | 1 |
| 26* | Zn-15% Cr | 0.05 | — | — | — | — | Δ | X | 3 |
| 27* | " | 0.1 | — | — | — | — | ○ | X | 2 |
| 28* | " | 1 | — | — | — | — | ○ | Δ | 3 |
| 29* | " | 5 | — | — | — | — | ○ | Δ | 3 |
| 30 | " | 0.1 | — | — | Zn-15% Cr | 0.1 | ○ | ○ | 2 |
| 31 | " | 0.1 | — | — | Zn-15% Cr | 10 | ○ | ○ | 1 |
| 32* | Zn-15% Co | 0.05 | — | — | — | — | Δ | X | 3 |
| 33* | " | 0.1 | — | — | — | — | ○ | X | 2 |
| 34* | " | 1 | — | — | — | — | ○ | Δ | 3 |
| 35* | " | 5 | — | — | — | — | ○ | Δ | 3 |
| 36 | Zn-15% Co | 0.1 | — | — | Zn-15% Co | 0.1 | ○ | ○ | 2 |
| 37 | " | 0.1 | — | — | Zn-15% Co | 10 | ○ | ○ | 1 |
| 38 | " | 0.1 | — | — | Zn-15% Mn | 0.1 | ○ | ○ | 2 |
| 39 | " | 0.1 | — | — | Zn-15% Mn | 10 | ○ | ○ | 1 |
| 40* | — | — | — | — | — | — | — | X | 1 |
| 41* | — | — | — | — | Zn-15% Ni | 10 | X | ○ | 4 |

*Comparative Runs

TABLE 2

| Run No. | First Layer (Displacement Plated Coating) Type | Weight ($g/m^2$) | Electroplated Coating: Middle Layer Type | Weight ($g/m^2$) | Uppermost Layer Type | Weight ($g/m^2$) | Adhesion of Plated Coating | Zinc Phosphating Property | Corrosion Resist. After Paint Coating | Press Formability |
|---|---|---|---|---|---|---|---|---|---|---|
| 1 | Zn-5% Ni | 0.5 | — | — | Zn-12% Ni | 20.0 | ○ | ○ | ○ | ○ |
| 2 | Zn-5% Fe | 1.5 | — | — | Zn-12% Ni | 20.0 | ○ | ○ | ○ | ○ |
| 3 | Zn-1% Co | 5.5 | — | — | Zn-12% Ni | 20.0 | ○ | ○ | ○ | ○ |
| 4 | Zn-1% Cr | 3.5 | — | — | Zn-12% Ni | 20.0 | ○ | ○ | ○ | ○ |
| 5 | Zn-5% Fe | 1.5 | — | — | Zn-15% Fe | 30.0 | ○ | ○ | ○ | ○ |
| 6 | Zn-5% Fe | 1.5 | Zn-15% Fe | 20.0 | Zn-85% Fe | 5.0 | ○ | ○ | ○ | ○ |
| 7 | Zn-5% Fe | 1.5 | — | — | Zn-15% Co | 20.0 | ○ | ○ | ○ | ○ |
| 8 | Zn-5% Fe | 2.5 | — | — | Zn-12% Cr | 20.0 | ○ | ○ | ○ | ○ |
| 9 | Zn-5% Fe | 4.5 | — | — | Zn-12% Mn | 20.0 | ○ | ○ | ○ | ○ |
| 10 | Zn-5% Fe | 3.5 | — | — | Zn | 20.0 | ○ | ○ | ○ | ○ |
| 11* | — | — | — | — | Zn-12% Ni | 20.0 | X | ○ | Δ | ○ |
| 12* | Zn-5% Fe | 20.0 | — | — | — | — | ○ | ○ | ○ | X |
| 13 | Zn | 1.5 | — | — | Zn-12% Ni | 20.0 | ○ | ○ | ○ | ○ |
| 14* | — | — | — | — | — | — | — | X | ○ | X |
| 15* | Ni | 20.0 | — | — | Zn-12% Ni | 20.0 | Δ | ○ | X | X |

*Comparative Runs

TABLE 3

| Run No. | First Layer (Displacement Plated Coating) Type | Weight ($g/m^2$) | Electroplated Coating: Middle Layer Type | Weight ($g/m^2$) | Uppermost Layer Type | M.P. (°C.) | Weight ($g/m^2$) | Adhesion of Plated Coating | Corrosion Resist. After Paint Coating | Spot Weldability (No. of Welded Spots) |
|---|---|---|---|---|---|---|---|---|---|---|
| 1* | — | — | — | — | Zn | 419 | 20 | X | 4 | 800 |
| 2 | Zn-5% Fe | 2 | — | — | Zn | 419 | 10 | ○ | 3 | 1900 |
| 3 | Zn-5% Fe | 1 | Zn | 20 | Zn-10% Fe | 700 | 0.5 | ○ | 3 | 1800 |
| 4* | — | — | Zn-1% Co | 20 | Zn-13% Ni | 850 | 0.5 | X | 4 | 800 |
| 5 | Zn-5% Fe | 1 | Zn-1% Co | 15 | Zn-13% Ni | 850 | 10 | ○ | 1 | 1800 |
| 6 | Zn | 1 | — | — | Zn-18% Fe | 900 | 20 | ○ | 1 | 2500 |
| 7 | Zn-5% Fe | 0.6 | — | — | Ni-18% Cr | 1500 | 25 | ○ | 1 | 2400 |
| 8 | Zn-5% Co | 0.5 | — | — | Ni | 1455 | 30 | ○ | 2 | 2500 |
| 9 | Zn-5% Cr | 0.8 | Zn | 20 | Cr-1% W | 1500 | 1 | ○ | 1 | 2300 |
| 10 | Zn-5% Ni | 1 | — | — | Cr-10% Fe | 860 | 25 | ○ | 2 | 2500 |
| 11 | Zn-5% Fe | 0.6 | Zn-15% Fe | 20 | Cr-3% C | 900 | 3 | ○ | 2 | 2400 |
| 12 | Zn | 0.5 | — | — | Ni-10% B | 1300 | 10 | ○ | 2 | 2500 |
| 13 | Zn-5% Fe | 0.8 | — | — | Ni-1% W | 1200 | 20 | ○ | 2 | 2300 |
| 14 | Zn-5% Co | 1 | — | — | Co-4% W | 1700 | 25 | ○ | 2 | 1800 |
| 15 | Zn-5% Cr | 1 | Zn-10% Mn | 10 | Fe-10% W | 600 | 10 | ○ | 1 | 2500 |
| 16 | Zn-5% Ni | 1 | Zn | 20 | Co-20% Mo | 1100 | 1 | ○ | 1 | 2500 |
| 17 | Zn-5% Fe | 0.6 | Zn-12% Ni | 20 | Fe-15% Mo | 890 | 2 | ○ | 1 | 2400 |
| 18 | Zn-5% Fe | 0.5 | Zn-5% Cr | 10 | Co-1% Ti | 1640 | 15 | ○ | 1 | 2500 |
| 19 | Zn 5% Fe | 0.8 | Zn-15% Fe | 20 | Fe-13% Cr | 770 | 3 | ○ | 1 | 2300 |
| 20* | Ni | 1 | — | — | Zn | 419 | 1 | Δ | 5 | 1300 |

*Comparative Runs

What is claimed is:

1. A multilayer plated aluminum sheet suitable for use in automobile body panels, comprising an aluminum sheet made of aluminum or an aluminum alloy, the aluminum sheet having a first layer of pure zinc or a zinc-base alloy formed by displacement plating on the surface of the aluminum sheet, and one or more layers of electroplated coating formed on the first layer by electroplating in an acidic sulfate bath, at least one layer of the electroplated coating being a pure zinc or zinc-base alloy and either the first layer or one layer of the electroplated coating or both being a zinc-base alloy.

2. The multilayer plated aluminum sheet of claim 1, wherein the first layer has a coating weight of 0.1–5 $g/m^2$.

3. The multilayer plated aluminum sheet of claim 2, wherein the first layer has a coating weight of 0.2–1.0 $g/m^2$.

4. The multilayer plated aluminum sheet of claim 1, wherein the first layer is a zinc-base alloy with one or more alloying elements nobler than zinc.

5. The multilayer plated aluminum sheet of claim 4, wherein the one or more alloying elements are selected from the group consisting of Ni, Fe, Co, and Cr.

6. The multilayer plated aluminum sheet of claim 1, wherein each layer of the upper electroplated coating has a coating weight of 0.1–40 $g/m^2$.

7. The multilayer plated aluminum sheet of claim 6, wherein the coating weight of each electroplated layer is at least 0.5 $g/m^2$.

8. The multilayer plated aluminum sheet of claim 7, wherein the coating weight of each electroplated layer is at least 1 $g/m^2$.

9. The multilayer plated aluminum sheet of claim 1, wherein the zinc-base alloy which forms at least one layer of the upper electroplated coating is a zinc-base alloy with one or more alloying elements selected from the group consisting of Ni, Fe, Co, Cr, and Mn.

10. The multilayer plated aluminum sheet of claim 1, wherein the uppermost layer of the upper electroplated coating is formed from a metallic material having a melting point above 500° C.

11. The multilayer plated aluminum sheet of claim 10, wherein the metallic material having a melting point above 500° C. is selected from zinc-base alloys with one or more alloying elements selected from the group consisting of Ni, Fe, Co, Cr, and Mn, or a metal selected from the group consisting of Fe, Ni, Cr, Co, Ti and alloys thereof.

12. The multilayer plated aluminum sheet of claim 10, wherein the uppermost layer has a coating weight of 1–40 g/m$^2$.

13. An automobile body panel made of the multilayer plated aluminum sheet of claim 10.

14. An automobile body panel made of the multilayer plated aluminum sheet of claim 1.

15. A multilayer plated aluminum sheet suitable for use in automobile body panels, comprising an aluminum sheet made of aluminum or an aluminum alloy, the aluminum sheet having a first layer of pure zinc or a zinc-base alloy formed by displacement plating on the surface of the aluminum sheet, and one or more layers of electroplated coating formed on the first layer by electroplating in an acidic sulfate bath, at least one layer of the electroplated coating being a pure zinc or zinc-base alloy having one or more alloying elements selected from the group consisting of Ni, Fe, Co, Cr and Mn, the uppermost layer of the upper electroplated coating being formed from a metallic material having a melting point above 500° C.

16. The multilayer plated aluminum sheet of claim 15, wherein the first layer has a coating weight of 0.1–5 g/m$^2$.

17. The multilayer plated aluminum sheet of claim 16, wherein the first layer has a coating weight of 0.2–1.0 g/m$^2$.

18. The multilayer plated aluminum sheet of claim 15, wherein the first layer is a zinc-base alloy with one or more alloying elements nobler than zinc.

19. The multilayer plated aluminum sheet of claim 18, wherein the one or more alloying elements are selected from the group consisting of Ni, Fe, Co, and Cr.

20. The multilayer plated aluminum sheet of claim 15, wherein each layer of the upper electroplated coating has a coating weight of 0.1–40 g/m$^2$.

21. The multilayer plated aluminum sheet of claim 20, wherein the coating weight of each electroplated layer is at least 0.5 g/m$^2$.

22. The multilayer plated aluminum sheet of claim 21, wherein the coating weight of each electroplated layer is at least 1 g/m$^2$.

23. The multilayer plated aluminum sheet of claim 15, wherein the metallic material having a melting point above 500° C. is selected from zinc-base alloys with one or more alloying elements selected from the group consisting of Ni, Fe, Co, Cr, and Mn, or a metal selected from the group consisting of Fe, Ni, Cr, Co, Ti and alloys thereof.

24. The multilayer plated aluminum sheet of claim 15, wherein the uppermost layer has a coating weight of 1–40 g/m$^2$.

25. An automobile body panel, comprising an aluminum sheet made of aluminum or an aluminum alloy, the aluminum sheet having a first layer of pure zinc or a zinc-base alloy formed by displacement plating on the surface of the aluminum sheet, and one or more layers of electroplated coating formed on the first layer by electroplating in an acidic sulfate bath, at least one layer of the electroplated coating being a pure zinc or zinc-base alloy having one or more alloying elements selected from the group consisting of Ni, Fe, Co, Cr and Mn, the uppermost layer of the upper electroplated coating being formed from a metallic material having a melting point above 500° C.

26. The automobile body panel of claim 25, wherein the first layer has a coating weight of 0.1–5 g/m$^2$.

27. The automobile body panel of claim 26, wherein the first layer has a coating weight of 0.2–1.0 g/m$^2$.

28. The automobile body panel of claim 25, wherein the first layer is a zinc-base alloy with one or more alloying elements nobler than zinc.

29. The automobile body panel of claim 28, wherein the one or more alloying elements are selected from the group consisting of Ni, Fe, Co, and Cr.

30. The automobile body panel of claim 25, wherein each layer of the upper electroplated coating has a coating weight of 0.1–40 g/m$^2$.

31. The automobile body panel of claim 30, wherein the coating weight of each electroplated layer is at least 0.5 g/m$^2$.

32. The automobile body panel of claim 31, wherein the coating weight of each electroplated layer is at least 1 g/m$^2$.

33. The automobile body panel of claim 25, wherein the metallic material having a melting point above 500° C. is selected from zinc-base alloys with one or more alloying elements selected from the group consisting of Ni, Fe, Co, Cr, and Mn, or a metal selected from the group consisting of Fe, Ni, Cr, Co, Ti and alloys thereof.

34. The automobile body panel of claim 25, wherein the uppermost layer has a coating weight of 1–40 g/m$^2$.

* * * * *